US011629888B2

(12) United States Patent
Okumura

(10) Patent No.: US 11,629,888 B2
(45) Date of Patent: Apr. 18, 2023

(54) CONNECTED-TYPE HOT-WATER SUPPLY SYSTEM

(71) Applicant: NORITZ CORPORATION, Hyogo (JP)

(72) Inventor: Kazuaki Okumura, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 0 days.

(21) Appl. No.: 17/578,459

(22) Filed: Jan. 19, 2022

(65) Prior Publication Data

US 2022/0235969 A1 Jul. 28, 2022

(30) Foreign Application Priority Data

Jan. 22, 2021 (JP) ..... JP2021-008724

(51) Int. Cl.

| | |
|---|---|
| ***F22B 35/00*** | (2006.01) |
| ***F24H 15/104*** | (2022.01) |
| ***F24H 15/335*** | (2022.01) |
| ***F24H 15/248*** | (2022.01) |

(52) U.S. Cl.
CPC ..... *F24H 15/104* (2022.01); *F24H 15/248* (2022.01); *F24H 15/335* (2022.01)

(58) Field of Classification Search
CPC ..... F22B 35/008; F22B 33/00; F22B 33/14; F22B 33/18; G05B 19/4155
See application file for complete search history.

(56) References Cited

U.S. PATENT DOCUMENTS

| | | | | |
|---|---|---|---|---|
| 4,598,668 | A * | 7/1986 | Bader | F22B 35/008 122/504 |
| 5,452,687 | A * | 9/1995 | Christiansen | F22B 35/008 236/78 D |
| 8,371,252 | B1 * | 2/2013 | Paine | F22B 37/06 122/448.3 |
| 8,651,064 | B2 * | 2/2014 | Paine | F22B 35/008 122/448.3 |
| 2017/0130971 | A1 * | 5/2017 | Wilson | F22B 35/008 |
| 2022/0120435 | A1 * | 4/2022 | Carrasco | F22B 35/18 |

FOREIGN PATENT DOCUMENTS

| | | |
|---|---|---|
| JP | 2016223745 | 12/2016 |
| JP | 2020016409 | 1/2020 |

* cited by examiner

*Primary Examiner* — Gregory A Wilson
(74) *Attorney, Agent, or Firm* — JCIPRNET

(57) ABSTRACT

A connected-type hot-water supply system includes hot-water supply apparatuses connected in parallel and a control means. The control means sets one main hot-water supply apparatus and sub-hot-water supply apparatuses, and performs leveling control of cumulative loads of the hot-water supply apparatuses by setting the main hot-water supply apparatus based on sequential rotation among the hot-water supply apparatuses. The control means includes a failure sign response mode in which it is determined whether there is a failure sign respectively for components of the hot-water supply apparatuses, and when a component of a part of hot-water supply apparatuses is a failure sign component determined to have a failure sign, a main use time of a hot-water supply apparatus having the failure sign component is increased, and the main use time is a main use time of serving as the main hot-water supply apparatus in the leveling control.

5 Claims, 8 Drawing Sheets

| Component importance | Component |
|---|---|
| High | combustion fan, burner, neutralizer, hot-water supply temperature sensor |
| Intermediate | heat exchanger, hot-water discharge temperature sensor |
| Low | water supply temperature sensor |
FIG. 10
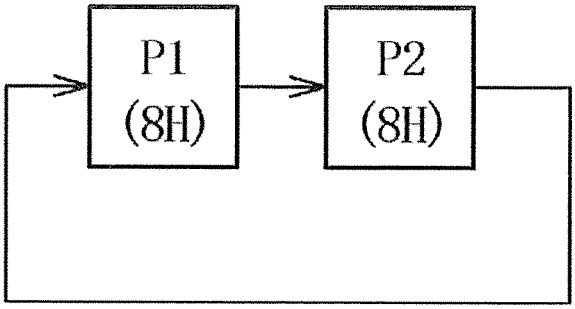
FIG. 11
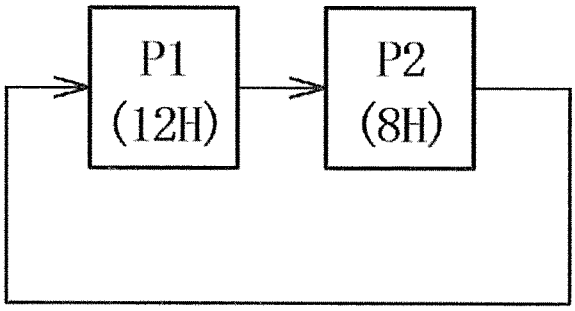
FIG. 12

CONNECTED-TYPE HOT-WATER SUPPLY SYSTEM

CROSS-REFERENCE TO RELATED APPLICATION

This application claims the priority benefit of Japan application serial no. 2021-008724, filed on Jan. 22, 2021. The entirety of the above-mentioned patent application is hereby incorporated by reference herein and made a part of this specification.

BACKGROUND

Technical Field

The disclosure relates to a connected-type hot-water supply system configured by connecting a plurality of hot-water supply apparatuses in parallel.

Description of Related Art

Conventionally, a connected-type hot-water supply system configured by connecting a plurality of hot-water supply apparatuses in parallel has been widely used. In this connected-type hot-water supply system, one main hot-water supply apparatus is set in advance from the plurality of hot-water supply apparatuses, and the main hot-water supply apparatus is first used at the start of hot water supply to supply hot water. Then, when the hot-water supply capacity is insufficient and cannot respond to the requirement with the main hot-water supply apparatus only, sub-hot-water supply apparatuses other than the main hot-water supply apparatus are used according to the insufficient hot-water supply capacity to supply hot water.

Since the main hot-water supply apparatus is constantly used during hot water supply, in the main hot-water supply apparatus, the cumulative load increases faster (the consumption progresses faster) than in the sub-hot-water supply apparatuses, and deterioration in the heating capacity and failures are likely to occur. To prevent such situations, the connected-type hot-water supply system performs control for leveling the cumulative loads.

For example, as in Patent Document 1 (Japanese Patent Application Laid-Open No. 2016-223745), a hot-water supply apparatus has been disclosed to level use records, which correspond to the cumulative loads, of a plurality of heating means by reducing the output of a heating means that has more use records than other heating means. Further, as in Patent Document 2 (Japanese Patent Application Laid-Open No. 2020-16409), a connected-type hot-water supply system has been disclosed to level the cumulative loads of a plurality of hot-water supply apparatuses by setting a next main hot-water supply apparatus based on sequential rotation when a use time of serving as the main hot-water supply apparatus reaches a predetermined time.

By leveling the cumulative loads of the hot-water supply apparatuses as in Patent Documents 1 and 2, it is possible to extend the service life as a connected-type hot-water supply system. However, at the end of the service life, since all the hot-water supply apparatuses have been consumed to the same extent, multiple hot-water supply apparatuses may fail at the same time, repairs may be concentrated, and the cost of repair one time may become high. In addition, although the connected-type hot-water supply system prevents a hot-water supply suspension by using a plurality of hot-water supply apparatuses, due to the leveling of the cumulative loads, multiple hot-water supply apparatuses may fail at the same time and hot water may not be supplied.

SUMMARY

A connected-type hot-water supply system of the disclosure of claim 1 includes a plurality of hot-water supply apparatuses connected in parallel and a control means. The control means controls a hot-water supply operation by changing a number of apparatuses to be used among the plurality of hot-water supply apparatuses according to a required hot-water supply capacity. The control means sets one main hot-water supply apparatus to be used first at a start of the hot-water supply operation and sub-hot-water supply apparatuses to be used when a hot-water supply capacity of the main hot-water supply apparatus is insufficient, and performs leveling control of leveling cumulative loads of the plurality of hot-water supply apparatuses by setting the main hot-water supply apparatus based on sequential rotation among the plurality of hot-water supply apparatuses. The control means includes a failure sign response mode in which it is determined whether there is a failure sign respectively for a plurality of components of the plurality of hot-water supply apparatuses, and when a component of a part of hot-water supply apparatuses among the plurality of hot-water supply apparatuses is a failure sign component determined to have a failure sign, a main use time of a hot-water supply apparatus having the failure sign component is increased, and the main use time is a main use time of serving as the main hot-water supply apparatus in the leveling control.

According to the above configuration, by setting the main hot-water supply apparatus based on sequential rotation to level the cumulative loads of the hot-water supply apparatuses, the control means extends the service life of the connected-type hot-water supply system. The leveling control includes a failure sign response mode in which the main use time of serving as the main hot-water supply apparatus is increased for a hot-water supply apparatus having a failure sign component determined to have a failure sign. Then, according to the failure sign response mode, the cumulative load of the hot-water supply apparatus having the failure sign component is increased faster than other hot-water supply apparatuses. Therefore, it is possible to prevent the failure occurrence time of the hot-water supply apparatus having the failure sign component from overlapping with failure occurrence times of other hot-water supply apparatuses, and it is possible to prevent simultaneous failure of multiple hot-water supply apparatuses, which is likely to occur due to the leveling of the cumulative loads.

In the connected-type hot-water supply system of the disclosure of claim 2 according to the disclosure of claim 1, when the part of hot-water supply apparatuses is multiple hot-water supply apparatuses, the failure sign response mode increases the main use time of a hot-water supply apparatus having the failure sign component of a shortest calculated component remaining life among the part of hot-water supply apparatuses.

According to the above configuration, when multiple hot-water supply apparatuses have failure sign components, the main use time of a hot-water supply apparatus having a failure sign component of a shortest calculated component remaining life is increased. Accordingly, when it is determined that there are failure signs of components in multiple hot-water supply apparatuses, the cumulative load of a hot-water supply apparatus having a failure sign component that has a shortest component remaining life and is expected to fail earliest is increased faster than other hot-water supply apparatuses. Therefore, it is possible to accelerate the failure occurrence time of the hot-water supply apparatus having the failure sign component of the shortest component remaining life, and it is possible to prevent the failure occurrence time from overlapping with failure occurrence times of other hot-water supply apparatuses.

In the connected-type hot-water supply system of the disclosure of claim 3 according to the disclosure of claim 1, when the part of hot-water supply apparatuses is multiple hot-water supply apparatuses, the failure sign response mode increases the main use time of a hot-water supply apparatus having the failure sign component of a highest component importance set in advance among the part of hot-water supply apparatuses.

According to the above configuration, when multiple hot-water supply apparatuses have failure sign components, the main use time of a hot-water supply apparatus having a failure sign component of a highest component importance among these failure sign components is increased.

Accordingly, when it is determined that there are failure signs of components in multiple hot-water supply apparatuses, the cumulative load of a hot-water supply apparatus having a failure sign component of a highest component importance among them is increased faster than other hot-water supply apparatuses. Therefore, it is possible to accelerate the failure occurrence time of the hot-water supply apparatus having the failure sign component of the highest component importance, and it is possible to prevent the failure occurrence time from overlapping with failure occurrence times of other hot-water supply apparatuses.

The connected-type hot-water supply system of the disclosure of claim 4 according to the disclosure of any one of claims 1 to 3 includes a plurality of pumps connected in parallel to be capable of circulating and supplying hot water to the plurality of hot-water supply apparatuses. The control means performs pump leveling control of leveling cumulative loads of the plurality of pumps by performing sequential rotation on a pump to be used among the plurality of pumps, and includes a pump failure sign response mode in which it is determined whether there is a pump failure sign for the plurality of pumps, and when there is the pump failure sign, a use time of the pump in the pump leveling control is increased as compared with a pump which does not have the pump failure sign.

According to the above configuration, by performing sequential rotation on the pump to be used for circulating and supplying hot water to the hot-water supply apparatuses so that warm water can be supplied immediately from the hot water taps, the cumulative loads of the pumps are leveled, and the service life of the connected-type hot-water supply system is extended. Then, according to a pump failure sign response mode which increases the use time in the pump leveling control of a pump having a pump failure sign, it is possible to accelerate the failure occurrence time of the pump having the pump failure sign, and it is possible to prevent the failure occurrence time from overlapping with a failure occurrence time of another pump.

In the connected-type hot-water supply system of the disclosure of claim 5 according to the disclosure of any one of claims 1 to 4, the control means is a management server communicably connected via an external communication network.

According to the above configuration, since the management server controls the hot-water supply operation performed by the hot-water supply apparatuses, the configuration of the connected-type hot-water supply system can be simplified, and in the configuration of the connected-type hot-water supply system, it is similarly possible to perform control so that the failure occurrence times do not overlap with each other.

BRIEF DESCRIPTION OF THE DRAWINGS

FIG. 10 is a chart showing a setting example of component importance.

FIG. 11 is a view showing a usual rotation setting example of a pump.

FIG. 12 is a view showing a rotation setting example of a failure sign response mode of a pump.

DESCRIPTION OF THE EMBODIMENTS

Embodiments of the disclosure provide a connected-type hot-water supply system capable of preventing failure occurrence times of a plurality of hot-water supply apparatuses from overlapping with each other.

Hereinafter, implementation of the disclosure will be described based on embodiments.

Embodiments

First, the configuration of a connected-type hot-water supply system will be described.

Figure 1:
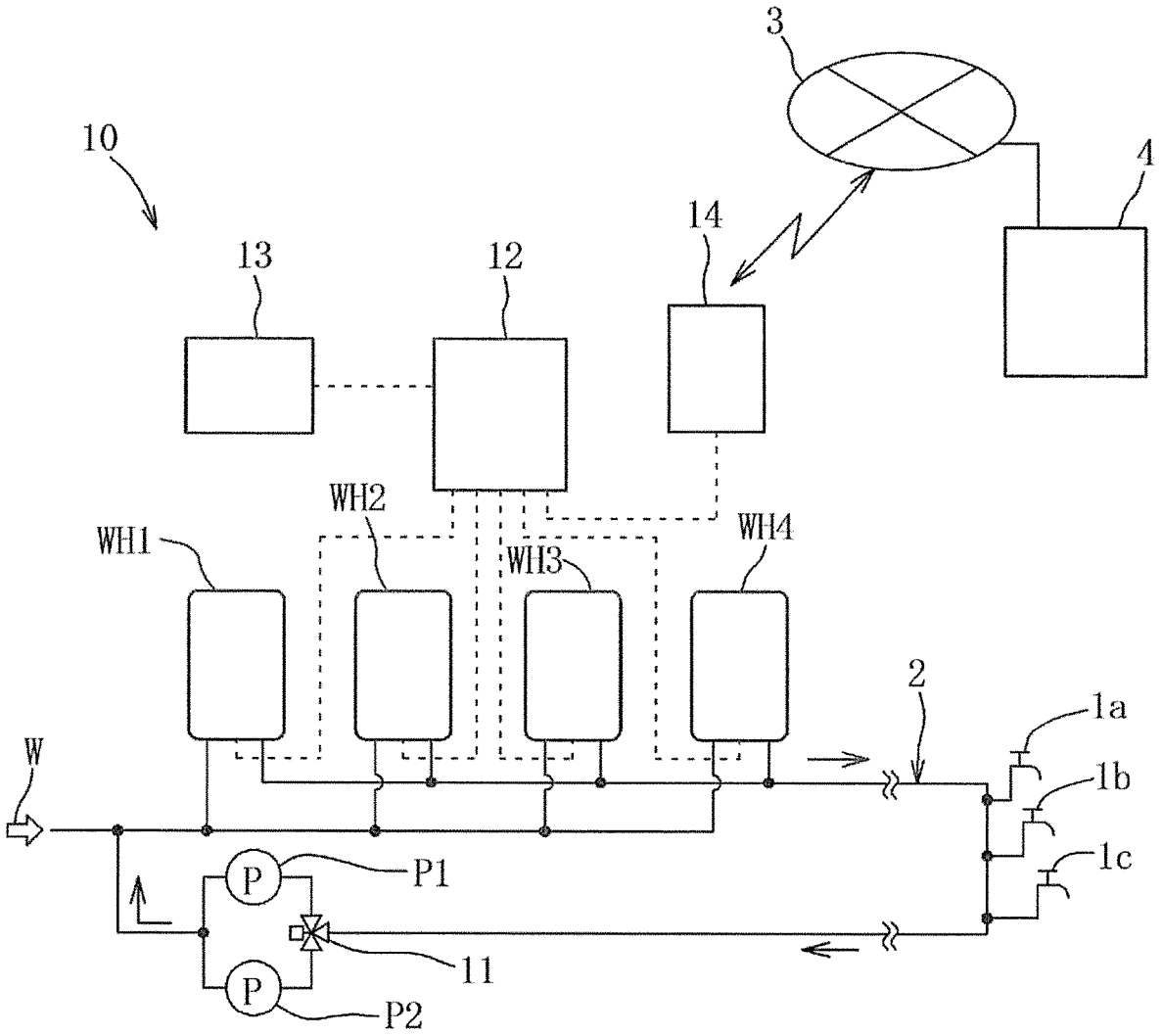
FIG. 1 is a view showing a configuration of a connected-type hot-water supply system according to an embodiment of the disclosure.

As shown in FIG. 1, in a facility having a plurality of hot water taps (not shown) in addition to, for example, hot water taps 1*a* to 1*c* as hot-water supply destinations, a circulation passage 2 which circulates warm water is laid so that hot water can be supplied immediately from any hot water tap. Since it is required that a water heater which supplies warm water to the circulation passage 2 can respond to demands ranging from a small flow rate hot water supply to a large flow rate hot water supply, and that a hot-water supply suspension due to a failure does not occur, a connected-type hot-water supply system 10 having a plurality of hot-water supply apparatuses serving as the water heaters is connected to the circulation passage 2. When hot water is supplied from the hot water tap, tap water is supplied to the circulation passage 2 as shown by an arrow W.

The connected-type hot-water supply system 10 includes a plurality of hot-water supply apparatuses WH1 to WH4 connected in parallel, a plurality of pumps P1 and P2 connected in parallel to the circulation passage 2 so that hot water can be circulated and supplied to the hot-water supply apparatuses WH1 to WH4, a switching valve 11 which switches the flow path according to the pumps P1 and P2 to be used, and a system controller 12 serving as a control means for driving the above devices to control a hot-water supply operation. The number of the hot-water supply apparatuses and the number of the pumps of the connected-type hot-water supply system 10 may be appropriately set according to, for example, the required hot-water supply capacity and the like.

An operation terminal 13 for performing various settings and a communication device 14 are communicably connected to the system controller 12, and the system controller 12 is connected to an external communication network 3 (e.g., the Internet) via the communication device 14. For example, a management server 4 which manages provision of a maintenance service based on operation information received from the connected-type hot-water supply system 10 is connected to the external communication network 3. The management server 4 is provided by a maintenance service provider or a manufacturer of the connected-type hot-water supply system 10 to be able to quickly respond to a problem that has occurred and able to prevent a problem that may occur.

Next, the hot-water supply apparatuses WH1 to WH4 will be described. Since the hot-water supply apparatuses WH1 to WH4 have the same configuration, the hot-water supply apparatus WH1 will be described, and descriptions of the hot-water supply apparatuses WH2 to WH4 will be omitted.

Figure 2:
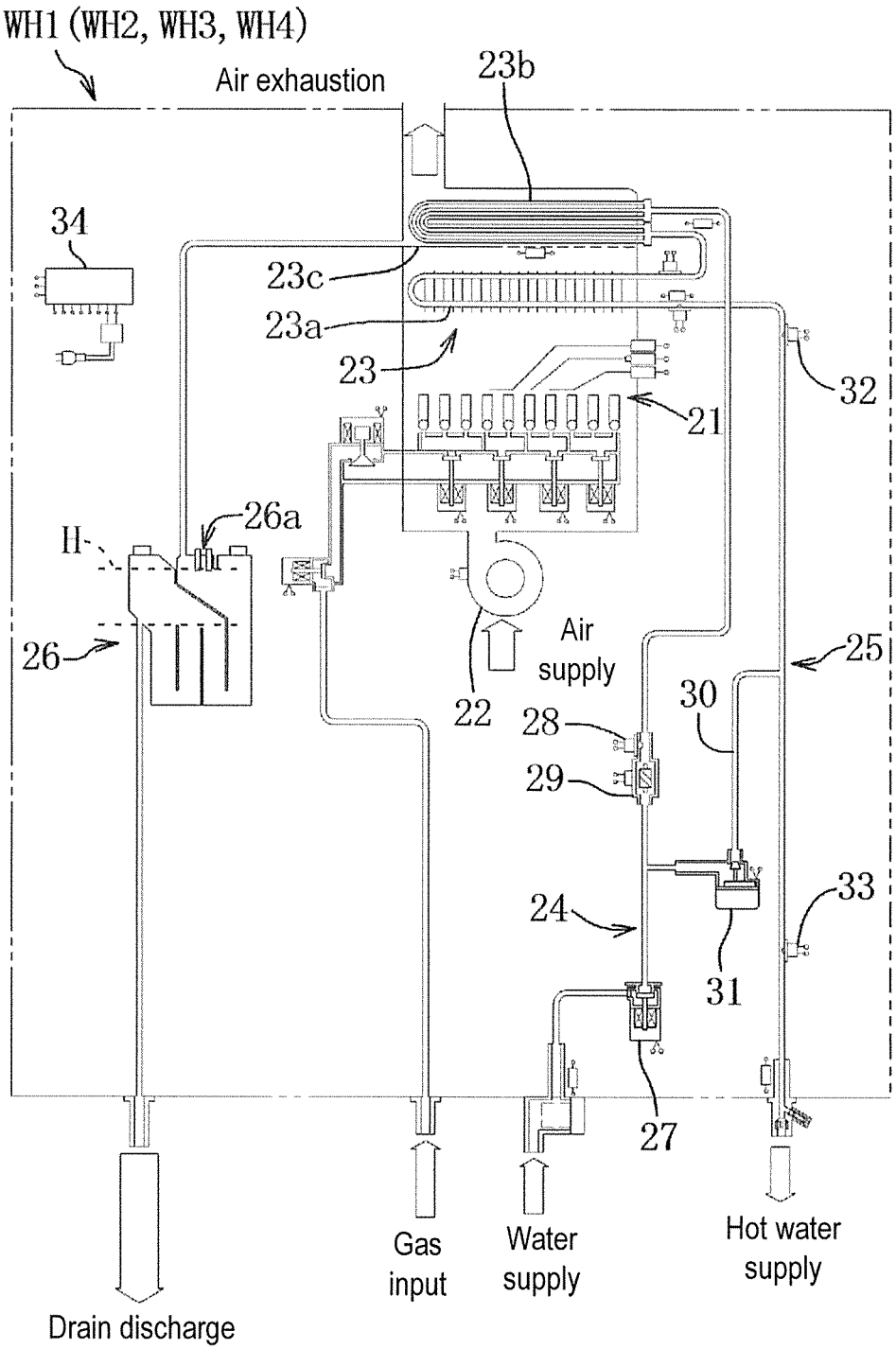
FIG. 2 is a view showing a configuration of a hot-water supply apparatus.

As shown in FIG. 2, the hot-water supply apparatus WH1 is a combustion-type water heater which heats hot water using the heat generated by burning a fuel gas. The hot-water supply apparatus WH1 includes a burner 21 which burns a fuel gas, a combustion fan 22 which supplies air for combustion, and a heat exchanger 23 which heats hot water by heat exchange with combustion gas generated by combustion.

The heat exchanger 23 includes a first heat exchanger 23*a* for recovering sensible heat of the combustion gas and a second heat exchanger 23*b* for recovering latent heat of the combustion gas from which the sensible heat has been recovered, and the second heat exchanger 23*b* and the first heat exchanger 23*a* are connected to each other. A water supply passage 24 for supplying tap water or the circulating hot water from the circulation passage 2 to the heat exchanger 23 is connected to the second heat exchanger 23*b*. A hot-water discharge passage 25 of hot water heated by the heat exchanger 23 is connected to the first heat exchanger 23*a*. Since acidic condensed water in which water contained in the combustion gas is condensed is generated in the second heat exchanger 23*b*, a drain pan 23*c* which collects the condensed water and a neutralizer 26 containing a neutralizing agent for neutralizing the condensed water collected in the drain pan 23*c* are provided. The neutralizer 26 has a water level detecting means 26*a* which detects an overflow that is equal to or higher than a water level H.

The water supply passage 24 includes an on-off solenoid valve 27, a water supply temperature sensor 28 which detects a temperature of hot water or tap water before being heated by the heat exchanger 23, and a water supply flow rate sensor 29 which detects a flow rate of hot water or tap water supplied to the heat exchanger 23. On the downstream side of the on-off solenoid valve 27, a bypass passage 30 is branched off from the water supply passage 24 and is connected to the hot-water discharge passage 25. The bypass passage 30 has a flow rate adjustment valve 31 for adjusting a flow rate of hot water or tap water before being heated to be mixed with the heated hot water of the hot-water discharge passage 25 to adjust the temperature of the hot water supply.

The hot-water discharge passage 25 includes a hot-water discharge temperature sensor 32 which detects a temperature of hot water heated by the heat exchanger 23, and a hot-water supply temperature sensor 33 which detects a temperature of hot water after temperature adjustment. Further, the hot-water supply apparatus WH1 includes a control part 34 which performs drive control of the combustion fan 22, drive control of the on-off solenoid valve 27 and the flow rate adjustment valve 31, and combustion control of the burner 21.

The control part 34 receives detection signals of the water supply temperature sensor 28, the water supply flow rate sensor 29, the hot-water discharge temperature sensor 32, and the hot-water supply temperature sensor 33. The control part 34 is communicably connected to the system controller 12 and opens and closes the on-off solenoid valve 27 based on a command of the system controller 12. When the on-off solenoid valve 27 is in an open state and the water supply flow rate sensor 29 detects a flow rate equal to or higher than a predetermined flow rate, combustion is started, and the flow rate adjustment valve 31 is adjusted to perform a hot-water supply operation of supplying hot water of adjusted temperature.

In the hot-water supply operation, driven components of the hot-water supply apparatus used are driven to target values as set (e.g., a target rotation speed of the combustion fan 22). Further, the hot-water supply operation includes, for example, not only the case of supplying hot water from the hot water taps 1*a* to 1*c*, but also the case of driving the pump P1 or the pump P2 to re-heat the warm water circulating in the circulation passage 2.

The system controller 12 sets one main hot-water supply apparatus from the hot-water supply apparatuses WH1 to WH4 in advance, and sets the rest as sub-hot-water supply apparatuses. For example, when the hot-water supply apparatus WH1 is set as the main hot-water supply apparatus, the on-off solenoid valve 27 of the hot-water supply apparatus WH1 is opened, and the on-off solenoid valves 27 of the hot-water supply apparatuses WH2 to WH4, which are set as the sub-hot-water supply apparatuses, are closed. For example, when the hot water tap 1*a* is opened, or when the pump P1 is driven, the hot-water supply apparatus WH1, which is set as the main hot-water supply apparatus, starts the hot-water supply operation upon detecting a flow rate equal to or higher than a predetermined flow rate by the water supply flow rate sensor 29.

Next, leveling control performed by the system controller 12 will be described.

Figure 3:
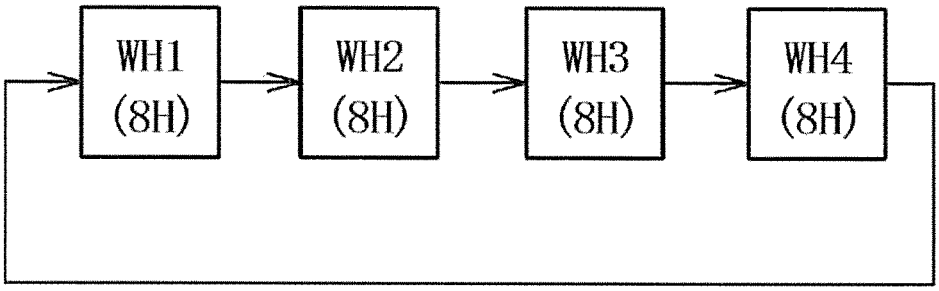
FIG. 3 is a view showing a usual rotation setting example of a main hot-water supply apparatus according to an embodiment.

As shown in FIG. 3, by setting the main hot-water supply apparatus based on sequential rotation, the system controller 12 performs leveling control which levels cumulative loads of the hot-water supply apparatuses WH1 to WH4.

For example, when a use time of serving as the main hot-water supply apparatus (i.e., a main use time) of the hot-water supply apparatus WH1 which is set as the main hot-water supply apparatus reaches a predetermined time (e.g., 8 hours) set in advance, the hot-water supply apparatus WH2 is set as a next main hot-water supply apparatus. Then, using the hot-water supply apparatus WH2 as the main hot-water supply apparatus, time counting of a main use time of the hot-water supply apparatus WH2 is started, and the main use time of the hot-water supply apparatus WH1, which is previously set as the main hot-water supply apparatus, is reset to zero.

Each time a combustion time of the main hot-water supply apparatus reaches the predetermined time, the main hot-water supply apparatus is set among the hot-water supply apparatuses WH1 to WH4 based on sequential rotation. Accordingly, since the main use times of the hot-water supply apparatuses WH1 to WH4 are leveled, the cumulative loads of the hot-water supply apparatuses WH1 to WH4 are leveled.

In the hot-water supply operation, when the hot water taps 1*a* to 1*c* and the like are used at the same time and the heating capacity with the main hot-water supply apparatus only is insufficient, the sub-hot-water supply apparatuses are sequentially operated to compensate for the insufficiency, and the number of apparatuses used is changed according to the required heating capacity. At this time, for example, the sequence of the sub-hot-water supply apparatuses to be burned is set so that a previous one main hot-water supply apparatus is the sub-hot-water supply apparatus that is operated last, according to the sequence of setting as the main hot-water supply apparatus.

The leveling control prevents combustion from concentrating on a particular hot-water supply apparatus and extends the service life of the connected-type hot-water supply system 10. On the other hand, since the cumulative loads of the hot-water supply apparatuses WH1 to WH4 are leveled, failures may occur at the same time to a part of the hot-water supply apparatuses WH1 to WH4 at the end of the service life.

When a failure occurs, the management server 4 is notified of failure occurrence, and after adjusting the repair schedule, a repair worker is dispatched from the maintenance service provider. If multiple hot-water supply apparatuses fail at the same time, the cost of repair one time becomes high and the burden on the user becomes heavy. Therefore, the system controller 12 performs leveling control of a failure sign response mode in which it is determined whether there is a failure sign for a plurality of components respectively included in the hot-water supply apparatuses WH1 to WH4, and a chance of using, as the main hot-water supply apparatus, a hot-water supply apparatus having a failure sign component determined to have a failure sign is increased. The leveling control having the failure sign response mode will be described based on the flowchart of FIG. 4 with reference to FIG. 5 and FIG. 6. In the figures, Si (i=1, 2, . . . ) represents a step.

For example, when the hot-water supply apparatus WH1 is set as the main hot-water supply apparatus, in S1, it is determined whether a set rotation time has elapsed. The rotation time is a time of serving as the main hot-water supply apparatus, and is set in advance to, for example, 8 hours for a hot-water supply apparatus that does not have a failure sign component. If the determination in S1 is No, the determination in S1 is repeated until the rotation time elapses, i.e., until the main use time of the hot-water supply apparatus WH1 reaches the rotation time. If the determination in S1 is Yes, the process proceeds to S2.

In S2, it is determined whether there is a failure sign component determined to have a failure sign among a plurality of components included in the hot-water supply apparatuses WH1 to WH4. The determination of whether there is a failure sign of a component is performed by the system controller 12 during the hot-water supply operation or during standby, and this determination result is used in S2.

Figure 5:
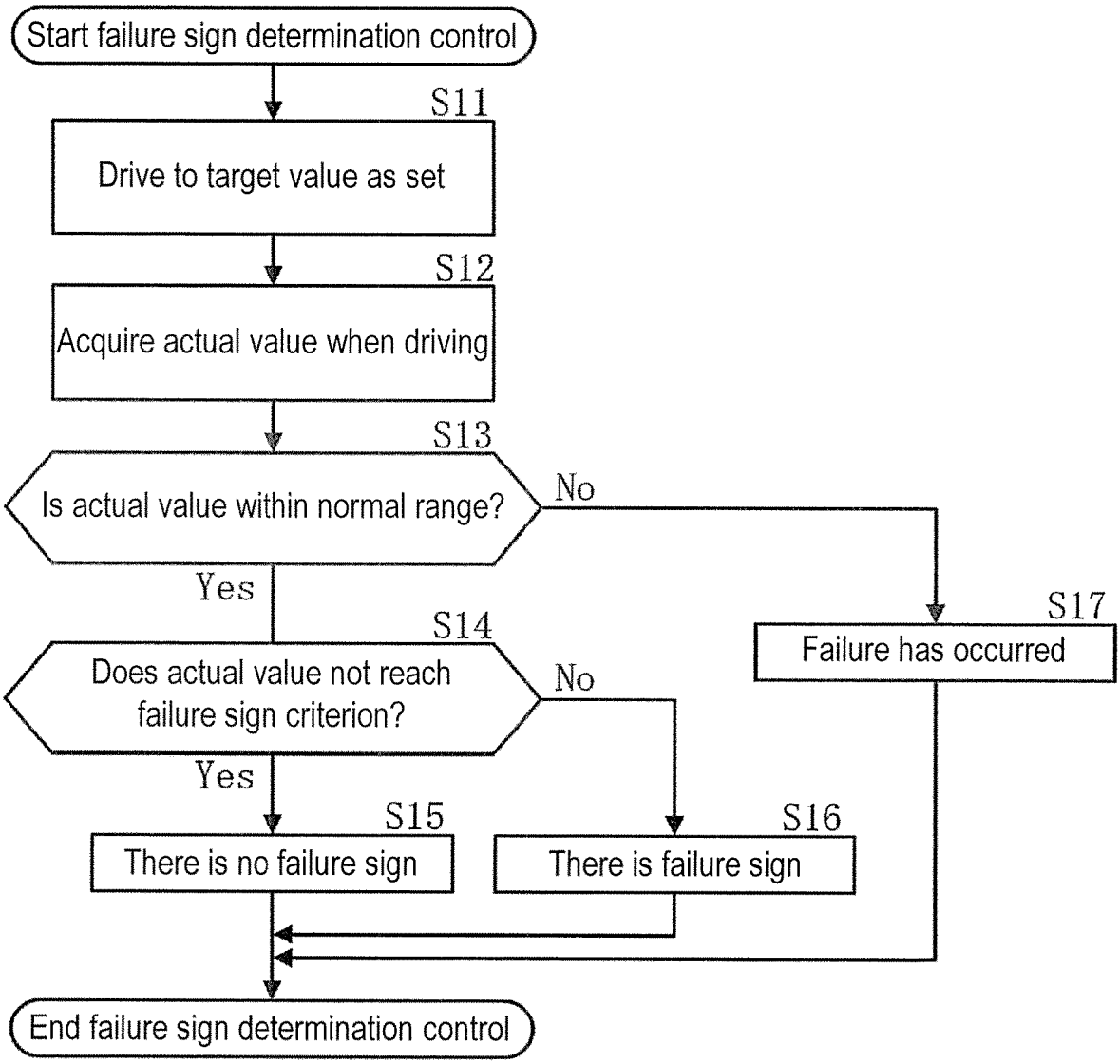
FIG. 5 is a flowchart of failure sign detection control of a drive component.

Herein, the determination of whether there is a failure sign of a component will be described. For example, as shown in FIG. 5, a drive component of the hot-water supply apparatus used for the hot-water supply operation is driven to a target value set for the hot-water supply operation (S11), and an actual value with respect to this target value is acquired (S12). Then, when the acquired actual value is within a normal range set in advance (Yes in S13) and reaches a failure sign criterion set in advance (No in S14), it is determined that this component is a failure sign component (S16).

When the acquired actual value is within the normal range set in advance (Yes in S13) and does not reach the failure sign criterion (Yes in S14), it is determined that there is no failure sign (S15). When the acquired actual value exceeds the normal range set in advance (No in S13), it is determined that a failure has occurred (S17), and use of the hot-water supply apparatus having this component is prohibited. The determination result of each component is transmitted to the management server 4.

Figure 6:
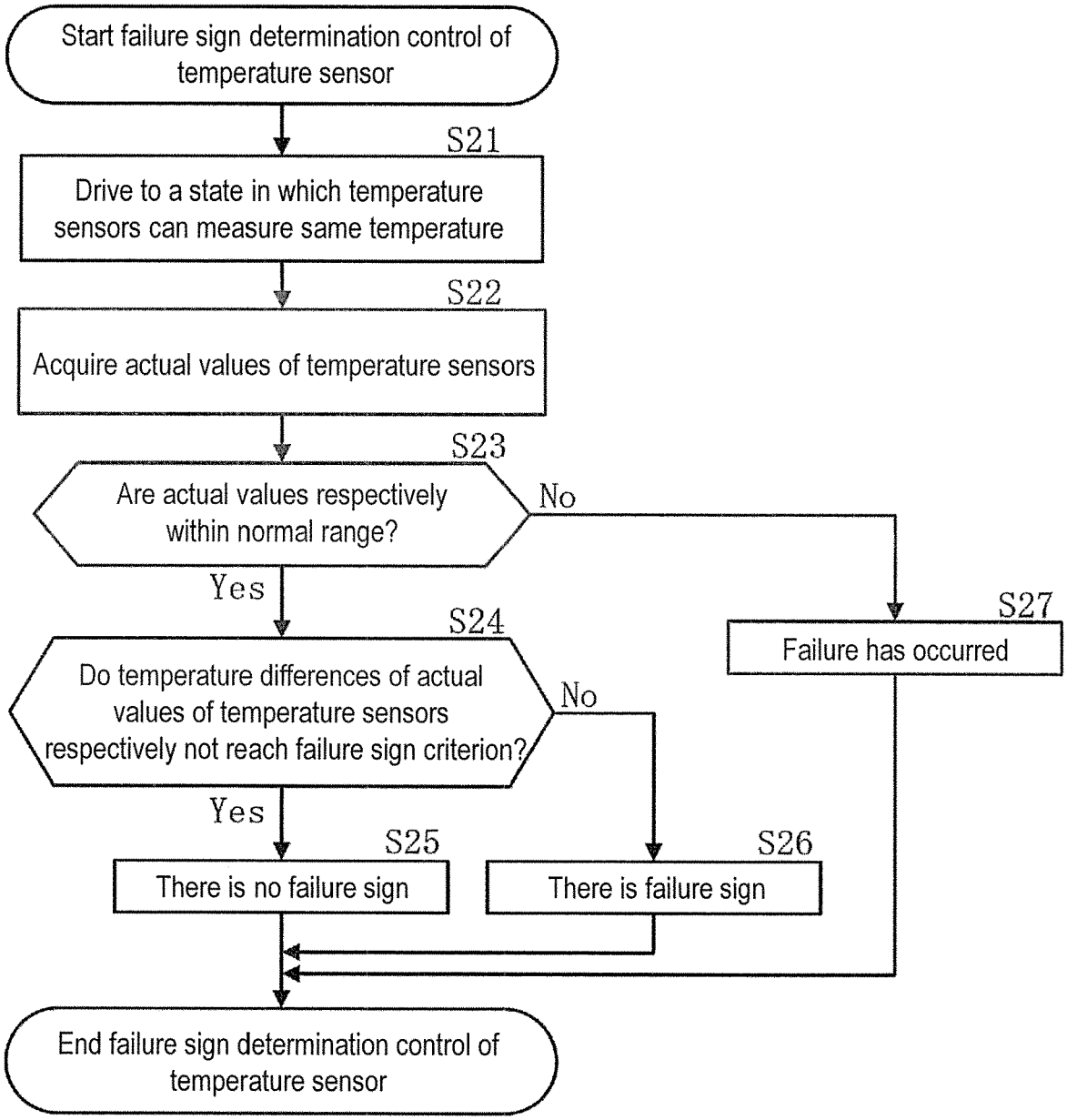
FIG. 6 is a flowchart of failure sign detection control of a temperature sensor.

Further, it is difficult to detect whether there is a failure sign during the hot-water supply operation for the water supply temperature sensor 28, the hot-water discharge temperature sensor 32, and the hot-water supply temperature sensor 33. Therefore, during standby, these temperature sensors are made capable of measuring a same temperature, for example, as shown in FIG. 6, with the on-off solenoid valve 27 opened, driving the pump P1 or the pump P2 without combustion (S21), and detection temperatures of the circulating hot water are respectively acquired (S22). When a temperature difference among them is within a normal range set in advance (Yes in S23) and reaches a failure sign criterion set in advance (No in S24), the temperature sensor common to the combinations that reach the failure sign criterion is determined as a failure sign component (S26). The detection temperatures may also be compared among the hot-water supply apparatuses WH1 to WH4.

When the temperature difference is within the normal range set in advance (Yes in S23) and does not reach the failure sign criterion set in advance (Yes in S24), it is determined that there is no failure sign (S25). When the temperature difference exceeds the normal range set in advance (No in S23), it is determined that a failure has occurred (S27), and use of the hot-water supply apparatus having this temperature sensor is prohibited. The determination result of each temperature sensor is transmitted to the management server 4.

Regarding the neutralizer 26, for example, when the water level detecting means 26*a* temporarily detects an overflow during the hot-water supply operation but then does not detect the overflow even though the hot-water supply operation is not stopped, it is regarded as a sign of obstruction, and the neutralizer 26 is determined to be a failure sign component. Further, it is determined whether a failure has occurred and whether there is a failure sign for the heat exchanger 23 based on, for example, a calculated thermal efficiency, and it is determined whether a failure has occurred and whether there is a failure sign for the burner 21 based on, for example, a responsiveness when the combustion amount is changed. These determination results are transmitted to the management server 4.

Figure 4:
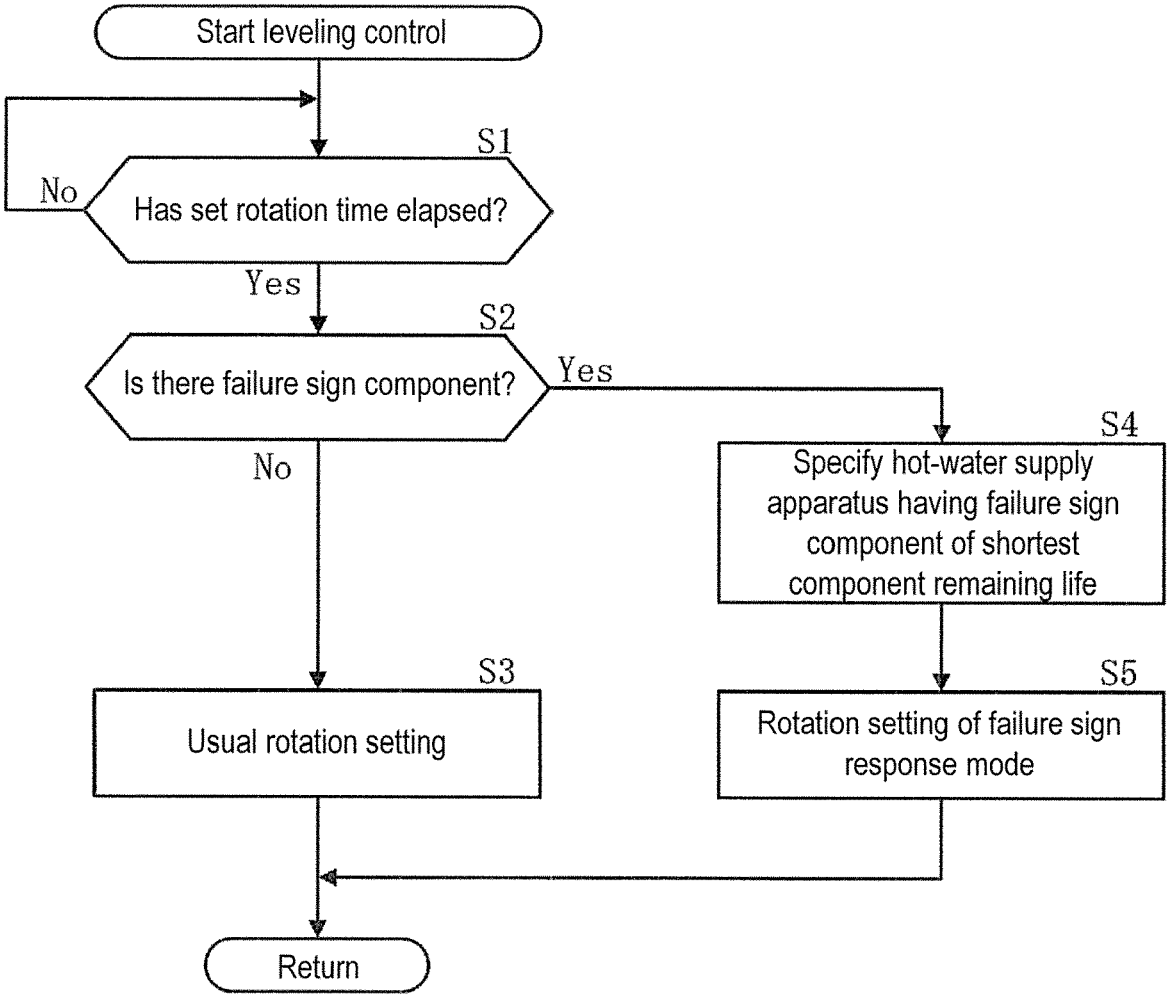
FIG. 4 is a flowchart of leveling control having a failure sign response mode according to an embodiment.

When the determination in S2 in FIG. 4 is No, the process proceeds to S3, and in S3, as usual (usual mode) leveling control, for example, the rotation time of the next main hot-water supply apparatus is set to a predetermined time (8 hours), and the process returns.

On the other hand, when the determination in S2 is Yes, the process proceeds to S4, and in S4, a hot-water supply apparatus having a failure sign component of a shortest calculated component remaining life among the failure sign components is specified, and the process proceeds to S5. The component remaining life may be calculated, for example, by subtracting a used time from a preset service life of the component, and may be calculated in consideration of a consumption speed and the like. When the number of failure sign components is one, the calculation of the component remaining life may be omitted.

In S5, leveling control of a failure sign response mode is performed and the process returns. In the leveling control of the failure sign response mode, a chance of using the hot-water supply apparatus specified in S4 as the main hot-water supply apparatus is increased to increase a main use time in one cycle of the rotation setting of the main hot-water supply apparatus.

Figure 7:
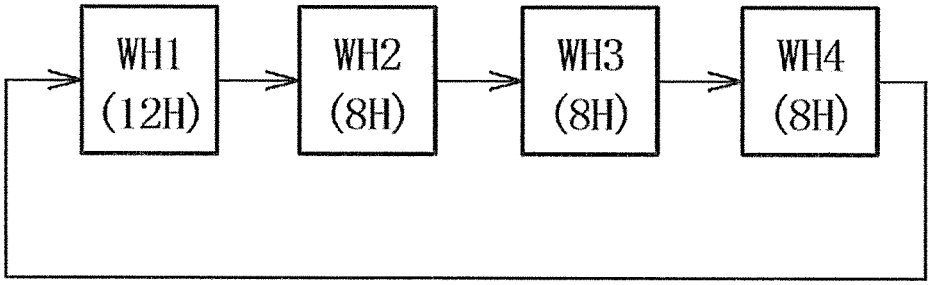
FIG. 7 is a view showing an example of rotation setting of the failure sign response mode.

For example, if the hot-water supply apparatus WH1 has the failure sign component of the shortest remaining life, as shown in FIG. 7, when the hot-water supply apparatus WH1 is next set as the main hot-water supply apparatus, a rotation time of 12 hours longer than the usual 8 hours is set. Accordingly, the main use time of the hot-water supply apparatus WH1 during one cycle of the rotation setting of the main hot-water supply apparatus is increased.

Figure 8:
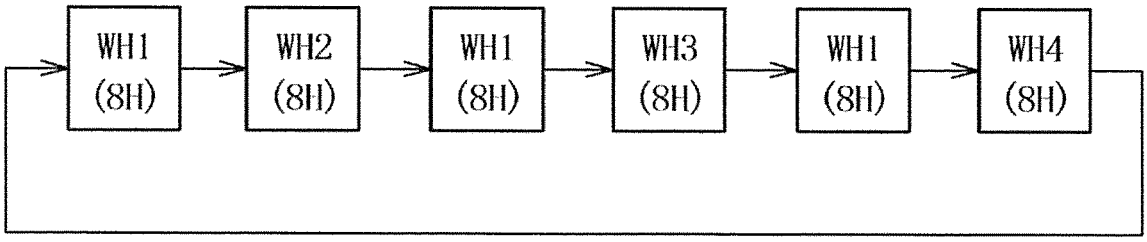
FIG. 8 is a view showing another example of rotation setting of the failure sign response mode.

Further, as shown in FIG. 8, by increasing a number of times of setting the hot-water supply apparatus WH1 as the main hot-water supply apparatus during one cycle of the rotation setting of the main hot-water supply apparatus, the main use time can also be increased. It is also possible to increase the main use time in a mode combining FIG. 7 and FIG. 8.

According to the leveling control of the failure sign response mode described above, it is possible to increase the main use time of the hot-water supply apparatus having the failure sign component assumed to have an earliest failure time due to the shortest component remaining life to accelerate the failure time. Then, since the failure time of the hot-water supply apparatus having the failure sign component of the shortest remaining life is accelerated, it is possible to prevent the failure time from overlapping with failure times of other hot-water supply apparatuses.

Figure 9:
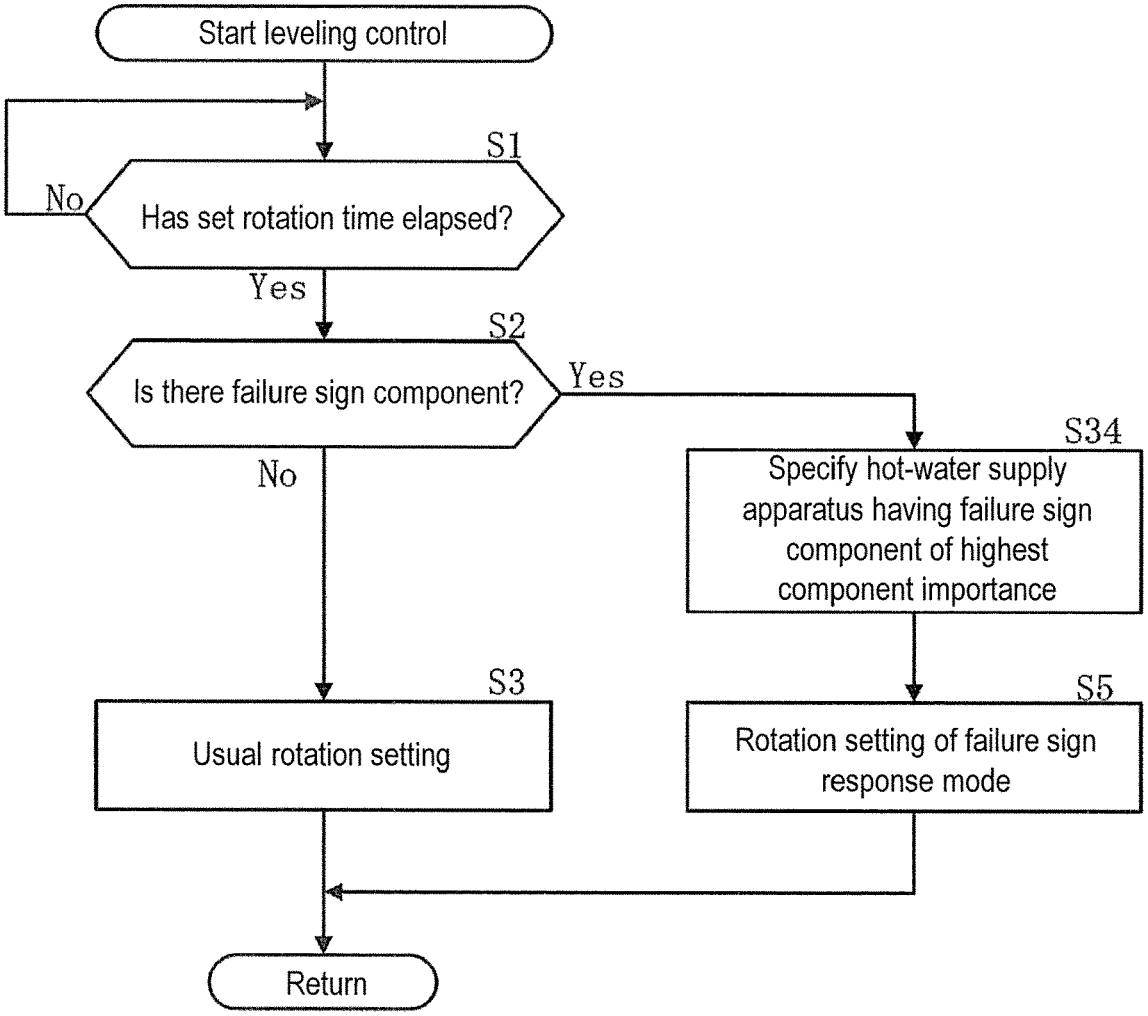
FIG. 9 is a flowchart showing another example of leveling control having the failure sign response mode.

In the leveling control, as shown in S34 of FIG. 9, the system controller 12 may also be configured to specify a hot-water supply apparatus having a failure sign component of a highest component importance set in advance, instead of specifying a hot-water supply apparatus having a failure sign component of a shortest calculated component remaining life as in S4 of FIG. 4. As shown in FIG. 10, the component importance is set high for components that give priority to safety and have a great influence on combustion control, and is set low for components that have alternative means in control.

For example, it is possible to perform feedback control of the flow rate adjustment valve 31 so that a detection temperature of the hot-water supply temperature sensor 33 becomes a hot-water supply set temperature, without using a water supply temperature detected by the water supply temperature sensor 28. Further, even if the heat exchange function of the heat exchanger 23 deteriorates due to adhesion of mineral components contained in tap water, for example, the insufficient hot-water supply capacity may be compensated for by other hot-water supply apparatuses.

On the other hand, if the blowing capacity of the combustion fan 22 is lowered, incomplete combustion may occur, and if the hot-water supply temperature sensor 33 fails, a high-temperature hot water supply leading to burns may occur, so the component importance of these components are set to high. If there are multiple failure sign components having the same component importance, a hot-water supply apparatus having a failure sign component of a shortest calculated component remaining life may be specified, or multiple hot-water supply apparatuses having failure sign components may be specified.

Similar to the above leveling control of the hot-water supply apparatuses WH1 to WH4, as shown in FIG. 11, by performing sequential rotation on the pump to be used between the pumps P1 and P2 for each use time (e.g., every 8 hours), the system controller 12 performs pump leveling control of leveling the pump cumulative loads. In the pump leveling control, for example, as shown in FIG. 12, by setting a use time of the pump P1 having a pump failure sign to be longer than usual, e.g., 12 hours, it is possible to accelerate a failure occurrence time of the pump P1 so that the failure occurrence time does not overlap with a failure time of another pump (i.e., the pump P2). Whether there is a pump failure sign is determined by the system controller 12 based on a set value such as a rotation speed when the pump is driven and an actual value with respect to the set value.

Figure 13:
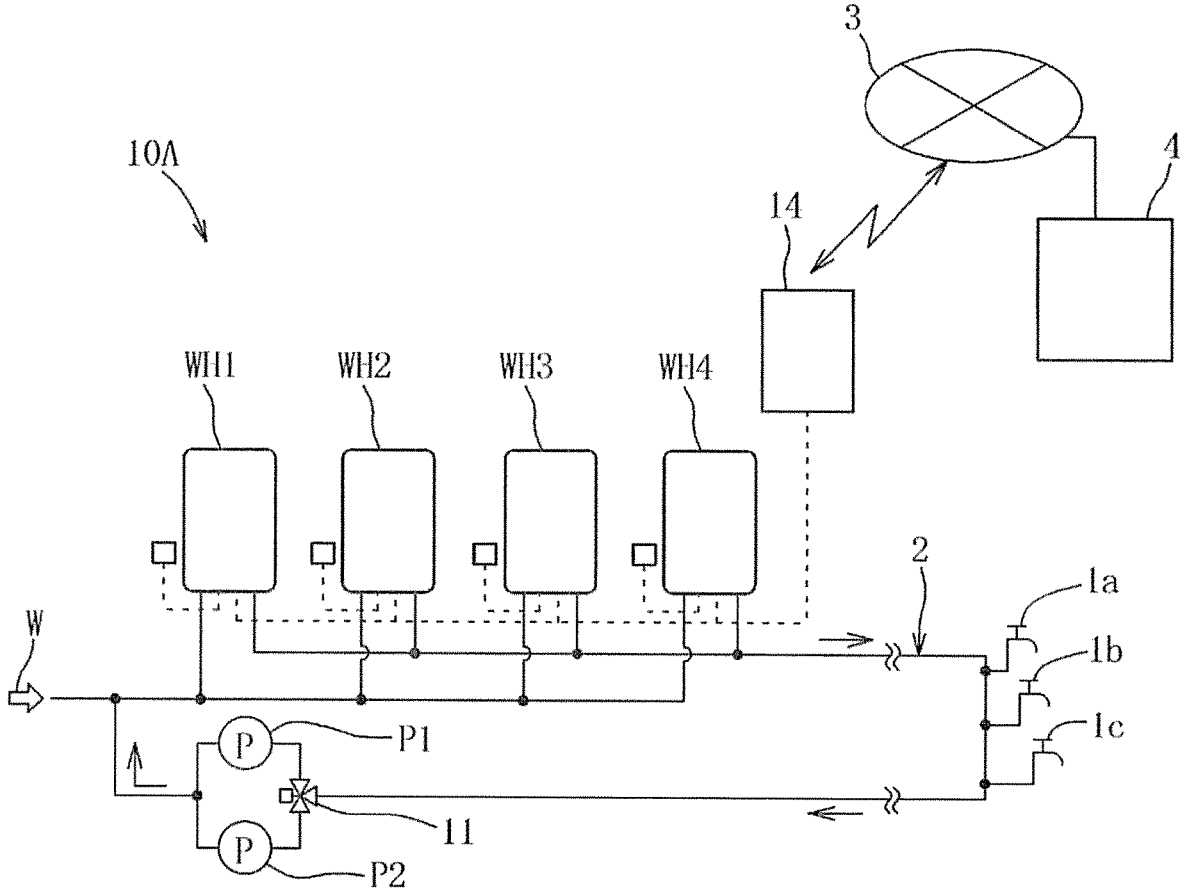
FIG. 13 is a view showing another configuration example of a connected-type hot-water supply system.

The control means for performing the leveling control and the pump leveling control above may also be the management server 4. Accordingly, not only in the connected-type hot-water supply system 10 of FIG. 1, but also in a connected-type hot-water supply system 10A which is simplified by omitting the system controller 12 as shown in FIG. 13, leveling control and pump leveling control similar to the above may be performed. In addition, the connected-type hot-water supply system 10A is configured so that each control part 34 of the hot-water supply apparatuses WH1 to WH4 may communicate with the management server 4 connected to the external communication network 3 via the communication device 14.

The actions and effects of the connected-type hot-water supply systems 10 and 10A according to the above embodiments will be described.

By setting the main hot-water supply apparatus based on sequential rotation to level the cumulative loads of the hot-water supply apparatuses WH1 to WH4, the system controller 12, which is the control means of the connected-type hot-water supply system 10, extends the service life of the connected-type hot-water supply system 10. Then, the leveling control includes a failure sign response mode in which the main use time of serving as the main hot-water supply apparatus is increased for a hot-water supply apparatus having a failure sign component determined to have a failure sign. According to the failure sign response mode, the cumulative load of the hot-water supply apparatus having the failure sign component is increased faster than other hot-water supply apparatuses. Therefore, it is possible to prevent the failure occurrence time of the hot-water supply apparatus having the failure sign component from overlapping with failure occurrence times of other hot-water supply apparatuses, and it is possible to prevent simultaneous failure of multiple hot-water supply apparatuses, which is likely to occur due to the leveling of the cumulative loads.

Further, in the failure sign response mode, when multiple hot-water supply apparatuses have failure sign components, the main use time of a hot-water supply apparatus having a failure sign component of a shortest calculated component remaining life is increased. Accordingly, when it is determined that there are failure signs of components in multiple hot-water supply apparatuses, the cumulative load of a hot-water supply apparatus having a failure sign component that has a shortest component remaining life and is expected to fail earliest is increased faster than other hot-water supply apparatuses. Therefore, it is possible to accelerate the failure occurrence time of the hot-water supply apparatus having the failure sign component of the shortest component remaining life, and it is possible to prevent the failure occurrence time from overlapping with failure occurrence times of other hot-water supply apparatuses.

When multiple hot-water supply apparatuses have failure sign components, it is also possible to increase the main use time of a hot-water supply apparatus having a component of a highest component importance set in advance among these failure sign components. Accordingly, when it is determined that there are failure signs of components in multiple hot-water supply apparatuses, the cumulative load of a hot-water supply apparatus having a failure sign component of a highest component importance among them is increased faster than other hot-water supply apparatuses. Therefore, it is possible to accelerate the failure occurrence time of the hot-water supply apparatus having the failure sign component of the highest component importance, and it is possible to prevent the failure occurrence time from overlapping with failure occurrence times of other hot-water supply apparatuses.

Similarly, regarding the pumps P1 and P2 used for circulating and supplying hot water to the hot-water supply apparatuses WH1 to WH4 so that warm water can be supplied immediately from the hot water taps 1*a* to 1*c*, by performing sequential rotation on the pump to be used, the pump cumulative loads of the pumps P1 and P2 are leveled, and the service life of the connected-type hot-water supply system 10 is extended. Then, according to a pump failure sign response mode which increases the use time in the pump leveling control of a pump having a pump failure sign, it is possible to accelerate the failure occurrence time of the pump having the pump failure sign, and it is possible to prevent the failure occurrence time from overlapping with a failure occurrence time of another pump.

In the connected-type hot-water supply system 10A which is simplified by omitting the system controller 12, the management server 4 may be used as the control means. Since the management server 4 controls the hot-water supply operation performed by the hot-water supply apparatuses WH1 to WH4, the configuration of the connected-type hot-water supply system 10A can be simplified, and in the configuration of the connected-type hot-water supply system 10A, it is similarly possible to prevent the failure occurrence times of the hot-water supply apparatuses WH1 to WH4 and the failure occurrence times of the pumps P1 and P2 from overlapping with each other.

In addition, a person skilled in the art may implement the embodiments in a form in which various modifications are added to the above embodiments without deviating from the gist of the disclosure, and the disclosure includes such modified forms.

What is claimed is:

1. A connected-type hot-water supply system comprising:

a plurality of hot-water supply apparatuses connected in parallel; and a control means controlling a hot-water supply operation by changing a number of apparatuses to be used among the plurality of hot-water supply apparatuses according to a required hot-water supply capacity, wherein the control means sets one main hot-water supply apparatus to be used first at a start of the hot-water supply operation and sub-hot-water supply apparatuses to be used when a hot-water supply capacity of the main hot-water supply apparatus is insufficient, and performs leveling control of leveling cumulative loads of the plurality of hot-water supply apparatuses by setting the main hot-water supply apparatus based on sequential rotation among the plurality of hot-water supply apparatuses, wherein the control means comprises a failure sign response mode in which it is determined whether there is a failure sign respectively for a plurality of components of the plurality of hot-water supply apparatuses, and when a component of a part of hot-water supply apparatuses among the plurality of hot-water supply apparatuses is a failure sign component determined to have a failure sign, a main use time of a hot-water supply apparatus having the failure sign component is increased, wherein the main use time is a main use time of serving as the main hot-water supply apparatus in the leveling control, wherein when the part of hot-water supply apparatuses is multiple hot-water supply apparatuses, the failure sign response mode increases the main use time of a hot-water supply apparatus having the failure sign component of a shortest calculated component remaining life among the part of hot-water supply apparatuses.

2. The connected-type hot-water supply system according to claim 1, comprising:

a plurality of pumps connected in parallel to be capable of circulating and supplying hot water to the plurality of hot-water supply apparatuses, wherein the control means performs pump leveling control of leveling cumulative loads of the plurality of pumps by performing sequential rotation on a pump to be used among the plurality of pumps, and comprises a pump failure sign response mode in which it is determined whether there is a pump failure sign for the plurality of pumps, and when there is the pump failure sign, a use time of the pump in the pump leveling control is increased as compared with a pump which does not have the pump failure sign.

3. The connected-type hot-water supply system according to claim 1, wherein the control means is a management server communicably connected via an external communication network.

4. A connected-type hot-water supply system comprising:

a plurality of hot-water supply apparatuses connected in parallel; and a control means controlling a hot-water supply operation by changing a number of apparatuses to be used among the plurality of hot-water supply apparatuses according to a required hot-water supply capacity, wherein the control means sets one main hot-water supply apparatus to be used first at a start of the hot-water supply operation and sub-hot-water supply apparatuses to be used when a hot-water supply capacity of the main hot-water supply apparatus is insufficient, and performs leveling control of leveling cumulative loads of the plurality of hot-water supply apparatuses by setting the main hot-water supply apparatus based on sequential rotation among the plurality of hot-water supply apparatuses, wherein the control means comprises a failure sign response mode in which it is determined whether there is a failure sign respectively for a plurality of components of the plurality of hot-water supply apparatuses, and when a component of a part of hot-water supply apparatuses among the plurality of hot-water supply apparatuses is a failure sign component determined to have a failure sign, a main use time of a hot-water supply apparatus having the failure sign component is increased, wherein the main use time is a main use time of serving as the main hot-water supply apparatus in the leveling control, the connected-type hot-water supply system further comprising:

a plurality of pumps connected in parallel to be capable of circulating and supplying hot water to the plurality of hot-water supply apparatuses, wherein the control means performs pump leveling control of leveling cumulative loads of the plurality of pumps by performing sequential rotation on a pump to be used among the plurality of pumps, and comprises a pump failure sign response mode in which it is determined whether there is a pump failure sign for the plurality of pumps, and when there is the pump failure sign, a use time of the pump in the pump leveling control is increased as compared with a pump which does not have the pump failure sign.

5. The connected-type hot-water supply system according to claim 4, wherein the control means is a management server communicably connected via an external communication network.

* * * * *